United States Patent [19]

Yodice et al.

[11] Patent Number: 4,957,648

[45] Date of Patent: Sep. 18, 1990

[54] SPIN FIBER LUBRICANT COMPOSITIONS

[75] Inventors: Richard Yodice, Mentor; Gregory A. Lentz, Twinsburg, both of Ohio

[73] Assignee: The Lubrizol Corporation, Wickliffe, Ohio

[21] Appl. No.: 478,060

[22] Filed: Feb. 7, 1990

Related U.S. Application Data

[63] Continuation of Ser. No. 82,769, Aug. 6, 1987, abandoned.

[51] Int. Cl.[5] ..... C10M 135/04

[52] U.S. Cl. ..... 252/8.6; 252/565; 260/410.9 R; 560/205; 560/265; 560/100; 560/103

[58] Field of Search ..... 252/8.6, 565; 560/265, 560/205, 100, 103; 260/410.9 R

[56] References Cited

U.S. PATENT DOCUMENTS

| | | | |
|---|---|---|---|
| 2,889,354 | 6/1959 | Blake | 260/468 |
| 3,037,052 | 5/1962 | Bortnick | 260/485 |
| 3,177,143 | 4/1965 | Lense | 252/8.9 |
| 3,380,242 | 2/1968 | Richmond | 57/140 |
| 3,464,922 | 9/1969 | Bernholz et al. | 252/8.6 |
| 3,575,856 | 4/1971 | Anton | 252/8.9 |
| 3,590,073 | 6/1971 | Carr | 260/476 R |
| 3,781,202 | 12/1973 | Marshall et al. | 252/8.7 |
| 3,785,973 | 1/1974 | Bernholz et al. | 252/8.8 |
| 3,827,114 | 8/1974 | Crossfield | 28/75 WT |
| 3,850,819 | 11/1974 | Shay | 252/8.75 |
| 3,859,122 | 1/1975 | Burks et al. | 117/138.8 F |
| 3,907,689 | 9/1975 | Carver | 252/8.7 |
| 3,926,816 | 12/1975 | Cohen et al. | 252/8.9 |
| 3,951,825 | 4/1976 | Carver | 252/8.7 |
| 3,954,631 | 5/1976 | Marshall et al. | 252/8.7 |
| 3,962,516 | 6/1976 | Marsyall et al. | 428/394 |
| 3,993,571 | 11/1976 | Marshall | 252/8.9 |
| 3,997,450 | 12/1976 | Steinmiller | 252/8.7 |
| 4,019,990 | 4/1977 | Marshall et al. | 252/8.9 |
| 4,066,558 | 1/1978 | Shay | 252/8.9 |
| 4,069,160 | 1/1978 | Hawkins | 252/8.9 |
| 4,103,068 | 7/1978 | Marshall et al. | 428/395 |
| 4,115,621 | 9/1978 | Hawkins | 252/8.9 |
| 4,659,488 | 4/1987 | Vinci | 252/33 |
| 4,704,225 | 11/1987 | Shay | 252/8.9 |

FOREIGN PATENT DOCUMENTS

| | | |
|---|---|---|
| 189804 | 8/1986 | European Pat. Off. . |
| 1336631 | 7/1963 | France . |
| 1422882 | 5/1966 | France . |
| 1092401 | 11/1967 | United Kingdom . |
| 1209591 | 10/1970 | United Kingdom . |
| 1492052 | 11/1977 | United Kingdom . |

*Primary Examiner*—John F. Niebling
*Assistant Examiner*—Isabelle Rodriguez
*Attorney, Agent, or Firm*—Joseph P. Fischer; Frederick D. Hunter; Robert A. Franks

[57] ABSTRACT

A spin fiber lubricant composition is disclosed. The composition is essentially comprised of a liquid carrier having therein an ester of the general structural formula (I):

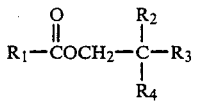

(I)

wherein $R_1$, $R_2$, $R_3$, and $R_4$ are hydrocarbyl groups preferably in the form of alkyl groups containing 1–6 carbon atoms. The composition has been found to be useful in connection with providing materials with lubricating properties which are desirable for the spinning of fibers.

37 Claims, No Drawings

SPIN FIBER LUBRICANT COMPOSITIONS

This is a continuation of copending application Ser. No. 07/082,769 filed on Aug. 6, 1987.

FIELD OF THE INVENTION

This invention relates to the preparation of esters of neoalcohols and to the use of such esters as an additive in a spin fiber lubricant. More particularly, the invention relates to spin fiber lubricant compositions comprised of a liquid carrier and esterified neoalcohols of a particularly defined structural formula.

BACKGROUND OF THE INVENTION

Spin finish, spinning finish, dressing, treating agent, spinning lubricant, coating fiber finish, processing agent, textile treating agent, textile treating composition, conditioning agent—all of these terms are used to designate the same material: an antistatic lubricant applied to the surface of man-made fibers as soon as practical after the fiber has been formed. The properties of the applied material are dictated by several factors, among which are the fiber to which it is applied and the processing to which the fiber is to be subjected. In general, once the fiber has been converted into yarn and then into fabric, the role of the finish is complete; it is usually removed prior to or during dyeing.

Natural fibers have their own finish. Cotton, for example, has a wax coating. The crude material extracted from raw cotton fiber by chloroform, carbon tetrachloride, benzene, or other organic solvents is usually called wax. Presumably most of the wax is located in the cuticle, which lies on the outside of the fiber. Most cotton which is spun contains its natural wax. Dewaxed cotton does not spin well. The wax undoubtedly has desirable lubricating properties for spinning.

In the production of synthetic continuous filament yarns, it is necessary to apply to the filaments during the spinning operation a lubricating composition to reduce friction developed as the yarns pass over the metal and ceramic machinery surfaces. Since they are applied during the spinning step, they are frequently referred to as spin finishes. Such finishes usually contain a lubricating ingredient to reduce friction, an antistatic agent to reduce the build-up of static electrical charges on the surfaces of the yarn as it passes over various machinery components, an antioxidant or thermal stabilizing agent to reduce the build-up of resin deposits on the machinery and the yarn itself, and an emulsifying agent in order that the total system may be applied to the yarn from an aqueous emulsion.

The primary function of a finish is to provide surface lubricity to the yarn such that smooth high-speed transfer over various metallic guides can take place with a minimum of fiber breakage.

Finishes also bring about fiber to fiber cohesiveness which is necessary to maintain uniform diameter and uniform twist configurations in the continuous multifilament yarn system and winding.

Most synthetic fibers, due to their hydrophobic nature, are static prone—that is, they demonstrate a marked tendency to retain electrostatic charges. During the processing of the yarn, high-speed operations accelerate generation and retention of electrostatic charges. Without static protection of yarn, several problems may occur thereto such as ballooning of yarn due to like charge repulsion between individual filaments, and tactile shock upon contact with processing equipment.

The electrostatic charges occurring on synthetic fibers may sometimes be disturbing to such a degree that they strongly impede or render completely impossible the further processing of the fibers.

To minimize wear and tear, heat damage, accumulation of static charges, and other like processing headaches, it has been found advantageous to enhance interfilament friction characteristics and fiber bundle cohesion generally by the use of finishes.

In preparation of yarns suitable for textile manufacture it is necessary to apply a lubricant to the filaments to permit processing of the yarn with minimum difficulty. As is well known in the art, selection of a suitable lubricant composition is not readily made, since many diverse requirements are imposed on the lubricant composition by the nature of a yarn's use and the manner in which it is manufactured. Of particular concern in high-temperature processing is the formation of hard insoluble resins and the fuming of the finish when contacting heated surfaces. Some earlier attempts at providing spin fiber lubricants are referred to below.

DESCRIPTION OF RELATED ART

U.S. Pat. No. 3,993,571 (Marshall, Nov. 23, 1976) relates to yarn finishing for multifilament yarns used in food packaging. The preferred finishing composition comprises butyl stearate, sorbitan monoleate and polyoxyethylene (20) sorbitan monooleate.

U.S. Pat. No. 3,827,114 (Crossfield, Aug. 6, 1974) is directed to a synthetic fiber finish which provides improved processing performance, heat stability, and the like, and comprises a heat stable, hydrophilic antistat of an alkoxylated polyhydric alcohol fatty acid ester or an ocylated alcohol ester; and a heat stable, hydrophilic emulsifier comprising alkylene oxide condensate of polyhydric alcohols and/or long chain fatty acid esters or alkylene oxide condensates of an alkaryl hydroxy terminated compound.

U.S. Pat. No. 4,049,766 (Eskridge, Sept. 20, 1977) relates to a continuous spin-draw winding of nylon 6 to produce yarn filaments of mixed beta-alpha crystalline morphology. The improvement is wherein prior to drawing, a spin finish emulsion containing from about 0.1 to about 6% by weight of benzyl alcohol is applied to the filaments to enhance conversion of the beta uniformity of dye acceptance to the drawn filaments.

U.S. Pat. 3,859,122 (Burks, Jr. et al, Jan. 7, 1975) relates to improved feed yarn for draw-texturing that has a finish composed of about 55 parts by weight of an ester oil lubricant, about 45 parts of a nonionic surface active emulsifier, and about 0.6 to 2 parts of poly(oxyethylene-oxy-1, 2-propylene) glycol having a viscosity of about 9,000 SUS. A preferred ester oil is di(tridecyl) adipate. A preferred emulsifier is a tetraoleate-laurate of a condensate of sorbitol with ethylene oxide, plus a small amount of a condensate of nonylphenol with ethylene oxide. Twist slippage and broken filaments are reduced to provide uniform textured yarn, and objectionable deposits on equipment are avoided.

SUMMARY OF THE INVENTION

The present invention is a spin fiber lubricant composition comprised of a liquid carrier and ester having the general formula:

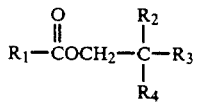

wherein $R_1$, $R_2$, $R_3$, and $R_4$ are independently straight chain hydrocarbyl groups, branched chain hydrocarbyl groups or mixtures thereof.

A primary object of the invention is to provide a novel group of spin fiber lubricant compositions which include a liquid carrier having particularly defined ester compounds therein.

A feature of the invention is that the esters as well as the spin fiber lubricant compositions can be easily and economically manufactured.

An advantage of the present invention is that the spin fiber lubricant composition provides lubricating properties which are desirable for spinning materials.

These and other objects, advantages and features of the present invention will become apparent to those skilled in the art upon reading the details of the structure, synthesis and usage as more fully set forth below. Reference being made to the accompanying general structural formula forming part hereof wherein like symbols refer to like molecular moieties throughout.

DETAILED DESCRIPTION OF THE PREFERRED EMBODIMENTS OF THE INVENTION

Before the present spin fiber lubricant compositions and processes for making such are described, it is to be understood that this invention is not limited to the particular compositions, materials or processes described as such, compositions and processes may, of course, vary. It is also to be understood that the terminology used herein is for the purpose of describing particular preferred embodiments only, it is not intended to be limiting since the scope of the present invention will be limited only by the appended claims.

In order to clarify the following description of the spin fiber lubricant compositions of the invention individual components of the composition will be described. Thereafter, examples of such components will be put forth followed by specific examples of the compositions including some and all of the individual components.

It must be noted that as used in this specification and the appended claims, the singular forms "a", "an" and "the" include plural referents unless the context clearly dictates otherwise. Thus, for example, a reference to "a composition" includes mixtures of such compositions, reference to "an ester" includes reference to mixtures of such esters, and reference to "an emulsifying agent" includes mixtures of emulsifying agents and so forth.

Before describing the individual components of the invention, it should also be noted that the spin fiber lubricant composition is essentially comprised of the liquid carrier and the ester as defined further below. However, other embodiments of the invention include the liquid carrier, ester and an emulsifying agent. Further, the invention also includes material having thereon the fiber lubricant comprised of the liquid carrier and the ester as well as materials having thereon the fiber lubricant comprised of the liquid carrier, ester and emulsifying agent. Methods of utilizing the spin fiber lubricant compositions and the esters described herein are also disclosed.

(A) Liquid Carrier

The purpose of the liquid carrier is to solubilize the ester of a neoalcohol. The preferred liquid carrier is water; however, if the ester is not water soluble, a liquid carrier consisting of oil may be used. The oil may be a mineral oil, vegetable oil or synthetic oil. Further, any carrier may be used with a solubilizer which increases the solubility of the ester in the carrier.

(B) Neoalcohol Ester

The neoalcohol esters which are used in the composition in accordance with the present invention are compounds characterized by the structural formula (I)

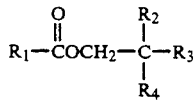

(I)

wherein $R_1$, $R_2$, $R_3$ and $R_4$ are independently straight chain hydrocarbyl groups, branched chain hydrocarbyl groups or mixtures thereof. The neoalcohol ester is made by the reaction of a neoalcohol with a carboxylic acid or anhydride or by transesterification of an ester with a neoalcohol. For example,

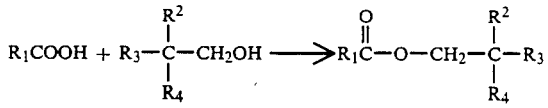

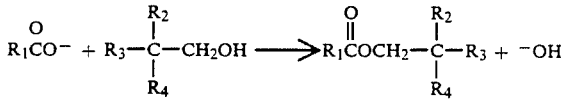

The neoalcohol ester is prepared by reacting equal equivalents of neoalcohol with equal equivalents of acid. However, in order to force the neutralization reaction to completion, an excess of the neoalcohol is employed. Normally, the neoalcohol is present in a 100% excess on an equivalent basis. Preferably, the neoalcohol is present in a 50% excess. The unreacted neoalcohol may be removed by distillation after the neutralization reaction is complete and reused for further neutralization reactions.

Normally, the neoalcohol and acid are added to a reaction vessel at room temperature. Stirring is begun and an acid catalyst is added to promote the reaction. The catalyst of choice is para-toluene sulfonic acid. Upon completion of the neutralization, the catalyst itself is neutralized with an appropriate base, such as aqueous sodium hydroxide.

The neoalcohol ester is normally formed at about 110° C., although it is preferred to conduct the reaction up to 150° C. The reaction further may be followed by monitoring the amount of water obtained.

As used in this specification and appended claims, the terms "hydrocarbyl" or "hydrocarbon-based" denote a group having a carbon atom directly attached to the remainder of the molecule and having predominantly hydrocarbon character within the context of this invention. Such groups include the following:

(1) Hydrocarbon groups; that is, aliphatic (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups, that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based group", "aryl-based group" and the like have meaning analogous to the above with respect to alkyl and aryl groups and the like.

The hydrocarbyl groups $R_2$, $R_3$ and $R_4$ may be alkyl groups containing from 1 to about 16 carbon atoms, preferably 1 to about 10 carbon atoms, and most preferably 1 to about 6 carbon atoms. Specific examples of alkyl groups of $R_2$, $R_3$ and $R_4$ includes methyl, ethyl, propyl, isopropyl, butyl, isobutyl, sec-butyl and t-butyl. Non-limiting examples of neoalcohols that may be employed in the practice of this are: 2,2-dimethyl-1-propanol, 2,2-dimethyl-1-butanol, 2,2-dimethyl-1-pentanol, 2,2-dimethyl-1-hexanol, 2,2-dimethyl-1-heptanol, 2,2-di-methyl-1-octanol, 2-methyl-2-ethyl-1-butanol, 2-methyl-2-ethyl-1-pentanol, 2-methyl-2-ethyl-1-hexanol, 2-methyl-2-ethyl-1-heptanol, 2-methyl-2-ethyl-1-octanol, 2,2-diethyl-1-butanol, 2,2-diethyl-1-pentanol, 2,2-diethyl-1-hexanol, 2,2-diethyl-1-heptanol, 2,2-diethyl-1-octanol, 2,2,3-trimethyl-1-butanol, 2,2,3-trimethyl-1-pentanol, 2,2,3-trimethyl-1-hexanol, 2,2,3-trimethyl-1-heptanol, 2,2,3-trimethyl-1-octanol, 2,3-dimethyl-2-ethyl-1-butanol, 2,2,4-trimethyl-1pentanol, 2,2,4-trimethyl-1-hexanol, 2,2,4-trimethyl-1-heptanol and 2,2,4-trimethyl-1-octanol.

The hydrocarbyl group $R_1$ of formula (I) is linked to an acid or anhydride selected from the group consisting of maleic acid, maleic anhydride, phthalic anhydride, aryl dicarboxylic acids, $HOOC(CH_2)_n$ wherein n is from 0 to about 20, dimerized acids of unsaturated monocarboxylic acids that contain at least 12 carbon atoms, $R_1COOH$,

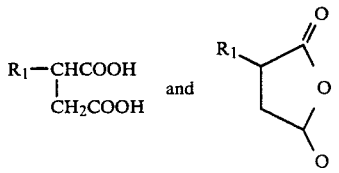

The hydrocarbyl group $R_1$ may also be an aliphatic or aromatic group selected from the group consisting of alkyl, alkenyl, aryl, alkaryl and aralkyl and mixtures thereof. The hydrocarbyl groups are alkyl or alkenyl groups containing from 4 to about 50 carbon atoms, preferably from 4 to about 22 carbon atoms, and most preferably from 10 to about 22 carbon atoms. Preferably $R_1$ is an alkyl group containing from 14 to 18 carbon atoms. Specific examples of alkenyl groups containing from 14 to 18 carbon atoms include the various tetradecenes, the various hexadecenes and the various octadecenes. The most preferred octadecene is 1-oleyl.

When $R_1$ is an aryl group the preferred hydrocarbyl groups are phenyl, alpha-naphthyl and beta-naphthyl.

When $R_1$ is an aralkyl group the preferred hydrocarbyl groups are alkyl-substituted phenyl, alkyl-substituted alpha-naphthyl and alkyl-substituted beta-naphthyl wherein the alkyl group is from 4 to 22 carbon atoms, and most preferably from 6 to 18 carbon atoms.

Non-limiting examples of carboxylic acids or anhydrides that may be reacted with neoalcohols are: formic acid, acetic acid, propionic acid, butyric acid, valeric acid, caproic acid, caprylic acid, capric acid, lauric acid, myristic acid, palmitic acid, stearic acid, oleic acid, linoleic acid, linolenic acid, phenylacetic acid, benzoic acid o-toluic acid, m-toluic acid, p-toluic acid, oxalic acid, malonic acid, succinic acid, glutaric acid, adipic acid, pimelic acid, suberic acid, azelaic acid, sebacic acid, maleic acid, phthalic acid, isophthalic acid, terephthalic acid, succinic anhydride, maleic anhydride and phthalic anhydride.

The carboxylic acid or anhydride is reacted with a neoalcohol in the presence of a catalyst such as para-toluene sulfonic acid. The course of the reaction is followed by monitoring the amount of water of neutralization obtained. The neutralization is conducted up to a temperature of 150° C. The catalyst is neutralized with a base, and the reaction mass is filtered to yield the product.

(C) Emulsifying Agent

The emulsifier of this invention is an alkylene oxide adduct of an organic compound having an active hydrogen atom. Useful emulsifiers also function as lubricants. Compounds suitable for use in preparing such adducts are fatty acids and fatty alcohols, preferably unsaturated, having 12 to 20 carbon atoms in their chains, polyhydric aliphatic alcohols and partial esters thereof, and alkyl phenols. Another class of suitable nonionic emulsifiers includes the partial fatty acid esters of polyols or their ethylene oxide adducts. As is known, ethylene oxide adducts have hydrophilic properties due to the ethylene oxide moiety, and when the other portion of the adduct is primarily hydrocarbon so as to provide a hydrophobic moiety, the compound can be expected to exhibit surface active properties. In general, ethylene oxide adducts containing a chain of at least at about 10 carbon atoms and at least three ethylene oxide units are useful in the practice of this invention. Preferably, the surface active adducts will contain at least about 10 ethylene oxide units in their molecules, since such compounds provide a composition with a high propensity for resisting the accumulation of electrostatic charges in addition to improving the manner in which the composition can were the filaments. Preferred surface active agents are the adducts of ethylene oxide with a partial ester of fatty acids having at least 12 carbon atoms with polyols containing 3 to 6 hydroxyl groups, and the products obtained by esterifying an adduct of ethylene oxide and a polyol having 3 to 6 hydroxyl groups with a fatty acid having 12 to 22 carbon atoms. These products may be partial or complete esters and will preferably contain 20 to 50 ethylene oxide units in their molecules. A particularly preferred member of this class of surfactants is the material prepared by reacting one mole of sorbitol with about 30 moles of ethylene oxide and esterifying the product with about 5 moles of a 4:1 mixture of oleic and lauric acids, it is preferred to use a mixture of this surfactant with an alkylphenoxy polyoxyethylene ethanol which, preferably, is the product of about 5 or 6 moles of ethylene oxide with one mole of nonylphenol. The combination of small quantities of about 2 to 10% (percentages of finish ingredients herein are weight percentages based on the weight of non-aqueous finish ingredients), of this emulsifier with the sorbitol derivative surfactant performs excellently. It is essential that the emulsifiers fully emulsify the ester component of the finish in water. The emulsifier should be stable under conditions of use, i.e., it should have little tendency to smoke and form insoluble deposits when the yarn carrying the finish contacts hot surfaces.

The poly(oxyethylene-oxy-1,-2-propylene) diol of the present invention can be prepared as shown in U.S. Pat. No. 2,425,845. Of the polyoxyalkylenes useful for this invention, the weight ratio of ethylene oxide groups, i.e., the groups ($CH_2$—$CH_2$—O), to propylene oxide groups, i.e., the groups

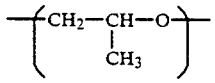

is between about 3:1 and 1:1 in order that the material remain fluid and water soluble. It is important that the viscosity of the polyoxyalkylene diol be between 5,000 and 50,000 SUS at 100° F.; preferably, its viscosity is about 9,000 SUS at 100° F. If the viscosity is too low, broken filaments of the yarn carrying the finish result; whereas, if the viscosity is too high, unwanted twist slippage in the draw texturing process occurs. It is also important that the finish contain not more than 5 percent, and preferably not more than 2 percent, of the diol component. If the finish contains more than about 5 percent, unwanted twist slippage occurs in the draw texturing process. Generally, if the viscosity of the diol is high, less is needed and vice versa.

The following examples illustrate the preparation of the ester of neoalcohols represented by formula (I). Unless otherwise indicated in the examples and elsewhere in this specification and claims, all parts and percentages are by weight, and all temperatures are in degrees Centigrade.

EXAMPLE A

Add a mixture consisting of 100 grams (0.82 equivalents) brassylic acid (tridecanedioic acid) and 159.8 grams (1.23 equivalents) of 2,2,4-trimethyl-1-pentanol to a reaction vessel. Stir and heat while passing nitrogen through the system at 0.5 cubic feet per hour. Add one gram of para-toluene sulfonic acid and heat the contents to 105° C. Collect about 10 milliliters of water in a Dean Stark Trap. Heat the contents to 150° C. Obtain the neutralization number (acidic) and add 50% aqueous sodium hydroxide to neutralize. Filter the contents and obtain the filtrate which should have a neutralization number (acidic) of about 1.5.

EXAMPLE B

Following essentially the same procedure of Example A, 160 grams (0.47 moles) erucic acid (cis $CH_3(CH_2)_7CH{=}CH(CH_2)_{11}COOH$ and 92 grams (0.71 moles) 2,2,4-trimethyl-1-pentanol are mixed and reacted. The neoalcohol ester obtained has a nil neutralization number (acidic).

EXAMPLE C

Following essentially the same procedure of Example A, 190 grams (0.61 moles) behenic acid and 119 grams (0.91 moles) of 2,2,4-trimethyl-1-pentanol are mixed and reacted. The neoalcohol ester is obtained in 84% yield.

EXAMPLE D

Following essentially the same procedure of example A, 100 grams (1.14 equivalents) azelaic acid and 222 grams (1.70 equivalents) 2,2,4-trimethyl-1-pentanol are mixed and reacted. The neoalcohol ester obtained has a 3.1 neutralization number (acidic).

EXAMPLE E

Five thousand, seven hundred seventy-five parts (25.33 moles) of a commercially available $C_{15-18}$ alpha-olefin fraction (having a carbon number distribution of 1% $C_{14}$, 29% $C_{15}$, 28% $C_{16}$, 27% $C_{17}$, 14% $C_{18}$, and 1% $C_{19}$) are passed through a 12-inch column packed with activated alumina into a 12-liter flask containing 2485 parts (25.35 moles) maleic anhydride. The mixture is heated to 214° C. and maintained at that temperature for 7 hours with a nitrogen sparge (0.2 standard cubic feet per hour) and cooled to room temperature. The mixture is heated to 214° C. and maintained at that temperature for 7 hours with a nitrogen sparge (0.2 standard cubic feet per hour) and cooled to room temperature. The mixture is then heated to 209°-212° C. and maintained at that temperature for 7 hours, then cooled to room temperature. 1500 parts of textile spirits are added and the mixture is stirred for one hour. The mixture is filtered with diatomaceous earth. The mixture is stripped under a vacuum of 0.7 mm Hg. at 168° C. then cooled to room temperature. The mixture is filtered with diatomaceous earth at room temperature. The filtrate is the desired product. 316 grams (2 equivalents) of the $C_{15-18}$ substituted succinic anhydride and 602 grams (3.5 equivalents) of 2,3,3-trimethyl-1-octanol are mixed and reacted according to the procedure of Example A.

EXAMPLE F

Charged to a reaction vessel are 198 parts (2.02 moles) of maleic anhydride and 500 parts (1.36 moles) of a commercial mixture of $C_{18-24}$ olefins available from Ethyl Corporation wherein these olefins are typically 10% $C_{18}$, 45% $C_{20}$, 25% $C_{22}$ and 15% $C_{24}$ and are comprised predominantly of substantially straight chain alpha, 1, 1-di-substituted and 1, 2-disubstituted olefins. This reaction mixture is heated to 200° C. and held at 200°-220° C. for 10 hours. Unreacted starting materials are removed by vacuum distillation to 5 mm Hg. at 200° C. The reaction mixture is filtered to yield the desired $C_{18-24}$ substituted succinic anhydride having an acid number of 290. 452 grams (2 equivalents) of the $C_{18-24}$ substituted succinic anhydride and 700 grams (3.25 equivalents) of 2, 2-dimethyl-1-pentanol are mixed and reacted according to the procedure of Example A.

EXAMPLE G

Charged to a reactor are 463 parts (4.72 equivalents) of maleic anhydride and 1000 parts (5.95 equivalents) of polypropylene tetramer. This reaction mixture is heated to 182° C. and held at this temperature for 9 hours. Unreacted starting materials are removed by vacuum distillation at 190° C. and 10 mm Hg. The reaction mixture is filtered to yield the desired polypropylene tetramersubstituted succinic anhydride having an acid number to phenolphthalein of 428. 296 grams (2.0 equivalents) of the polypropylene tetramer substituted succinic anhydride and 700 grams (3.25 equivalents) of 2-methyl-2-ethyl-1-butanol are mixed and reacted according to the procedure of Example A.

In one embodiment, the spin finish composition of the present invention comprises a concentrate of a two-component system of about 20–50% of the ester of a neoalcohol and 50–80% of a liquid carrier. Preferably, the ester is present at a level of 25–45% and the carrier at 55–75%, and most preferably, the ester is present at 30–40% and the carrier at 60–70%.

In another embodiment, the spin finish composition of the present invention comprises a concentrate of a three-component system of carrier, ester and emulsifying agent containing about 30–55% of the carrier, 30–50% of the neoalcohol ester and 15–25% of the emulsifying agent. Preferably, the carrier is present at 35–50%, the ester at 35–45% and the emulsifying agent at 15–25%. Most preferably, the carrier is present at 40%, the ester at 40% and the emulsifying agent at 20%, with all components at ±2%.

In one embodiment, the spin finish composition of the present invention comprises about 35–45 weight percent of a neoalcohol ester, 15–25 weight percent of an emulsifying agent and 35–50 weight percent of a carrier preferably in the form of coconut oil.

In applying the finishing composition of this invention to the filaments, e.g., nylon, conventional methods may be employed. In general, good results are obtained in both hot and cold drawing operations when the finishing composition is applied in amounts ranging from about 0.2 to 1.5 percent and more preferably 0.8 to 1.0 percent by weight, based on the weight of the yarn. The finishing composition is desirably applied as an aqueous emulsion containing about 12 to 25 percent of the finishing composition. The finishing composition is applied to the yarn prior to drawing by conventional techniques which comprise, for example, bringing the yarn in contact with the composition while it moves during the course of production. The composition may be applied to the yarn by various methods and devices which may include use of lubricating roll, wick, or having the yarn pass through a bath containing the finishing composition.

The following table shows examples of the spin fiber lubricant composition. These examples are provided so as to provide those of ordinary skill in the art with a complete disclosure and description of how to make the spin fiber lubricant compositions of the invention and are not intended to limit the scope of what the inventors regard as their invention. Efforts have been made to ensure accuracy with respect to numbers used (e.g., relative amounts, temperature, etc.) but some experimental errors and deviation should be accounted for. Unless indicated otherwise, parts are parts by weight, temperature is in degrees centigrade, and pressure is at or near atmospheric. The table demonstrates the use of the spin finish of the present invention.

A polycaprolactam yarn (200 denier-32 filament) is prepared by conventional spin-draw techniques. Immediately after spinning the spin finish, in a three-component system, consisting of an ester of a neoalcohol, glycerol trioleate or an ethoxylated sorbitol ester of a mixture of oleic acid and lauric acid, and coconut oil is applied to the yarn at the rate of 0.1–2 weight percent based on the weight of the yarn and preferably 0.5 to 1 percent by weight of the yarn as 15 weight percent emulsion in water by means of a conventional kiss roll application.

In a two-component system where the spin finish consists of coconut oil and an ester of a neoalcohol, the spin finish is applied to the yarn at the rate of 0.2–2.5 weight percent based on the weight of the yarn and preferably 0.8 to 1.5 percent by weight of the yarn.

The composition of this invention may also be used with other agents such as anti-static agents, product stability agents, corrosion resistance agents, etc.

Finish Compositions

| | Finish Compositions | | | | | | | | | | |
|---|---|---|---|---|---|---|---|---|---|---|---|
| | Composition in Weight Percent | | | | | | | | | | |
| Components | I | II | III | IV | V | VI | VII | VIII | IX | X | XI |
| Composition of Example A | 40 | 40 | | | | | | | | | |
| B | | | 40 | 38 | 35 | | | | | | |
| C | | | | | | 42 | 40 | | | | |
| D | | | | | | | | 40 | | | |
| E | | | | | | | | | 38 | | |
| F | | | | | | | | | | 38 | |
| G | | | | | | | | | | | 38 |
| Glycerol trioleate | | 15 | 18 | | | 20 | 20 | 22 | | | |
| EtO/sorbitol (30/1)m/[oleic acid/lauric acid (4/1)m] (1/5)m | 15 | | | 20 | 20 | | | | 15 | 17 | 17 |
| Coconut oil | 45 | 45 | 42 | 42 | 45 | 38 | 40 | 38 | 47 | 45 | 45 |

The instant invention is shown and described herein and was considered to be the most practical, and preferred embodiments. It is recognized, however, that departures may be made therefrom which are within the scope of the invention and that obvious modifications will occur to one skilled in the art upon reading this disclosure.

What is claimed is:

1. A composition comprising (A) a liquid carrier and (B) at least one ester having the general formula

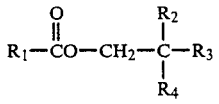

wherein $R_1$ is selected from the group consisting of alkyl groups containing from 10 to about 22 carbon atoms, alkenyl groups containing from 4 to about 50 carbon atoms, aryl groups, alkaryl groups and aralkyl groups, and $R_2$, $R_3$, and $R_4$ are straight chain hydrocarbyl groups, branched chain hydrocarbyl groups or mixtures thereof, wherein said composition has utility as a spin fiber lubricant.

2. The composition according to claim 1 wherein $R_2$, $R_3$ and $R_4$ are alkyl groups containing from 1 to about 16 carbon atoms.

3. The composition according to claim 2 wherein $R_2$, $R_3$ and $R_4$ are alkyl groups containing from 1 to about 10 carbon atoms.

4. The composition according to claim 3 wherein $R_2$, $R_3$ and $R_4$ are alkyl groups containing from 1 to about 6 carbon atoms.

5. The composition according to claim 4 wherein $R_2$ and $R_4$ are methyl or ethyl groups.

6. The composition according to claim 5 wherein $R_3$ is an alkyl group containing from 1 to about 6 carbon atoms.

7. The composition according to claim 6 wherein $R_2$ and $R_4$ are methyl groups and $R_3$ is an isobutyl group.

8. The composition according to claim 1 wherein $R_1$ is an alkyl or alkenyl group containing from 4 to about 22 carbon atoms.

9. The composition according to claim 8 wherein $R_1$ is an alkenyl group containing from 10 to about 22 carbon atoms.

10. The composition according to claim 9 wherein the alkenyl group contains from 14 to 18 carbon atoms.

11. The composition according to claim 10 wherein the alkenyl group contains 17 carbon atoms.

12. The composition according to claim 1 wherein $R_1$ is an alkyl group containing from 14 to 18 carbon atoms.

13. The composition according to claim 1 wherein $R_1$ is an aryl group selected from the group consisting of phenyl, alpha-naphthyl and beta-naphthyl.

14. The composition according to claim 1 wherein the liquid carrier is selected from the group consisting of oil and water.

15. A spin fiber concentrate comprising from about 50–80% of a liquid carrier and from about 20–50% of the ester of claim 1.

16. A fibrous material having thereon a spin fiber concentrate according to claim 15 wherein the spin fiber concentrate is present on the material in an amount in the range of about 0.1–2 percent by weight based upon the weight of the fibrous material.

17. A process for preparing an additive which comprises reacting (A) a neoalcohol having the structure

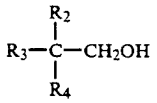

wherein $R_2$, $R_3$ and $R_4$ are independently straight chain hydrocarbyl groups, branched chain hydrocarbyl groups or mixtures thereof, with (B) an acid of the general formula:

$R_1COOH$, wherein $R_1$ is a hydrocarbyl group selected from the group consisting of alkyl, alkenyl, aryl, alkaryl and aralkyl and mixtures thereof, wherein said additive has utility as a spin fiber lubricant.

18. The process according to claim 17 wherein $R_2$, $R_3$ and $R_4$ rae alkyl groups containing from 1 to about 16 carbon atoms.

19. The process according to claim 18 wherein $R_2$, $R_3$ and $R_4$ are alkyl groups containing from 1 to about 10 carbon atoms.

20. The process according to claim 19 wherein $R_2$, $R_3$ and $R_4$ are alkyl groups containing from 1 to about 6 carbon atoms.

21. The process according to claim 20 wherein $R_2$ and $R_4$ are methyl or ethyl groups.

22. The process according to claim 21 wherein $R_3$ is an alkyl group containing from 1 to about 6 carbon atoms.

23. The process according to claim 22 wherein $R_2$ and $R_4$ are methyl groups and $R_3$ is an isobutyl group.

24. The process according to claim 17 wherein $R_1$ is an alkyl or alkenyl group containing from 4 to about 50 carbon atoms.

25. The process according to claim 24 wherein $R_1$ is an alkyl or alkenyl group containing from 4 to about 22 carbon atoms.

26. The process according to claim 25 wherein $R_1$ is an alkyl or alkenyl group containing from 10 to about 22 carbon atoms.

27. The process according to claim 26 wherein the alkenyl group contains from 14 to 18 carbon atoms.

28. The process according to claim 27 wherein the alkenyl group contains 17 carbon atoms.

29. The process according to claim 17 wherein $R_1$ is an aryl group selected from the group consisting of phenyl, alpha-naphthyl and beta-naphthyl.

30. The process according to claim 17 wherein the equivalent ratio of neoalcohol to acid is about 1:1.

31. The process according to claim 17 wherein the reaction of neoalcohol to acid is conducted at a temperature from about ambient up to about 150° C.

32. The process according to claim 17 wherein the reaction of a neoalcohol with an acid is conducted in the presence of an acid catalyst.

33. A fibrous material having thereon a composition according to claim 1 wherein the spin fiber composition is present on the material in an amount in the range of about 0.1–2 percent by weight based upon the weight of the fibrous material.

34. A fibrous material having thereon a composition comprising a spin fiber lubricant composition comprising (A) a liquid carrier;

(B) at least one ester having the general formula:

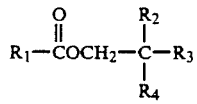

wherein $R_1$, $R_2$, $R_3$, and $R_4$ are straight chain hydrocarbyl groups, branched chain hydrocarbyl groups or mixtures thereof.

35. The fibrous material according to claim 34 wherein $R_2$, $R_3$ and $R_4$ are alkyl groups containing from 1 to about 16 carbon atoms.

36. The fibrous material according to claim 34 wherein $R_1$ is selected from the group consisting of alkyl, alkenyl, aryl, alkaryl and aralkyl groups and mixtures thereof.

37. The fibrous material according to claim 34 wherein the liquid carrier is oil or water.

* * * * *